United States Patent [19]

Buck, Jr. et al.

[11] 4,363,680

[45] Dec. 14, 1982

[54] PROCESS FOR CONTACTING A POWDER WITH A FIBROUS WEB

[75] Inventors: George S. Buck, Jr.; Roger V. Russell, both of Memphis, Tenn.

[73] Assignee: Fiberlok Inc., Memphis, Tenn.

[21] Appl. No.: 192,344

[22] Filed: Sep. 30, 1980

Related U.S. Application Data

[63] Continuation of Ser. No. 74,677, Sep. 12, 1979, abandoned.

[51] Int. Cl.[3] ..... B05D 1/12

[52] U.S. Cl. ..... 156/62.6; 156/62.2; 156/283; 156/204; 156/320; 118/310; 118/312; 427/195; 427/209

[58] Field of Search ..... 156/62.2, 62.6, 283, 156/204, 320; 427/195, 209; 118/309, 310, 312; 19/302

[56] References Cited

U.S. PATENT DOCUMENTS

| | | | |
|---|---|---|---|
| 2,324,787 | 7/1943 | Lundgren | 118/309 |
| 2,348,578 | 5/1944 | Soissa | 118/312 X |
| 2,441,492 | 5/1948 | Koon et al. | 427/195 X |
| 2,569,765 | 10/1951 | Kellett et al. | 118/312 X |
| 2,573,835 | 11/1951 | Dyar | 91/18 |
| 2,643,188 | 6/1953 | Meyer | 118/309 X |
| 2,878,776 | 3/1959 | Vogel | 118/24 |
| 3,002,849 | 10/1961 | Harmon et al. | 118/309 X |
| 3,013,891 | 12/1961 | Block | 118/309 |
| 3,262,423 | 7/1966 | Willhite | 118/309 X |
| 3,577,290 | 5/1971 | Baskerville et al. | 156/62.2 |
| 3,616,035 | 10/1971 | Baskerville | 156/296 |
| 3,777,706 | 12/1973 | Kaufman | 118/603 |
| 3,993,518 | 11/1976 | Buck et al. | 156/62.6 |

*Primary Examiner*—Shrive P. Beck
*Attorney, Agent, or Firm*—Quaintance & Murphy

[57] ABSTRACT

A process for contacting a moving fibrous web with a powder. The process comprises the steps of:

I. passing a mixture of powder and air through the moving fibrous web;

II. reversing the direction of movement of the fibrous web; and then

III. passing a mixture of powder and air through the moving fibrous web in a direction opposite to that of Step I.

An apparatus comprising an air-tight enclosure; means for maintaining subatmospheric pressure within the enclosure; means for passing a fibrous web through the enclosure; and means within the enclosure for passing a mixture of powder and air through the moving fibrous web.

16 Claims, 9 Drawing Figures

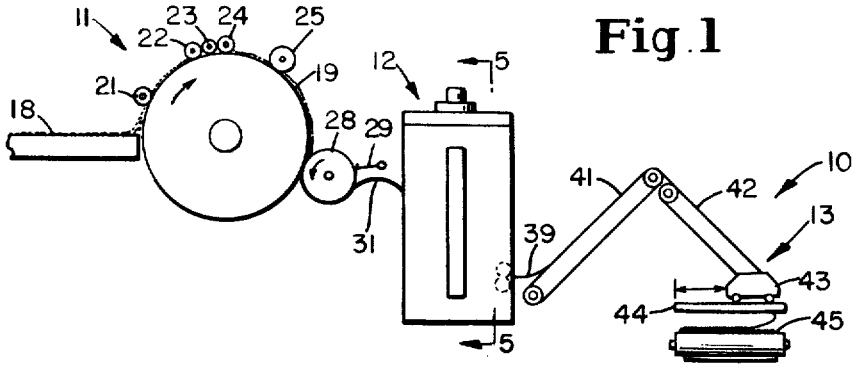
Fig. 1
Fig. 2
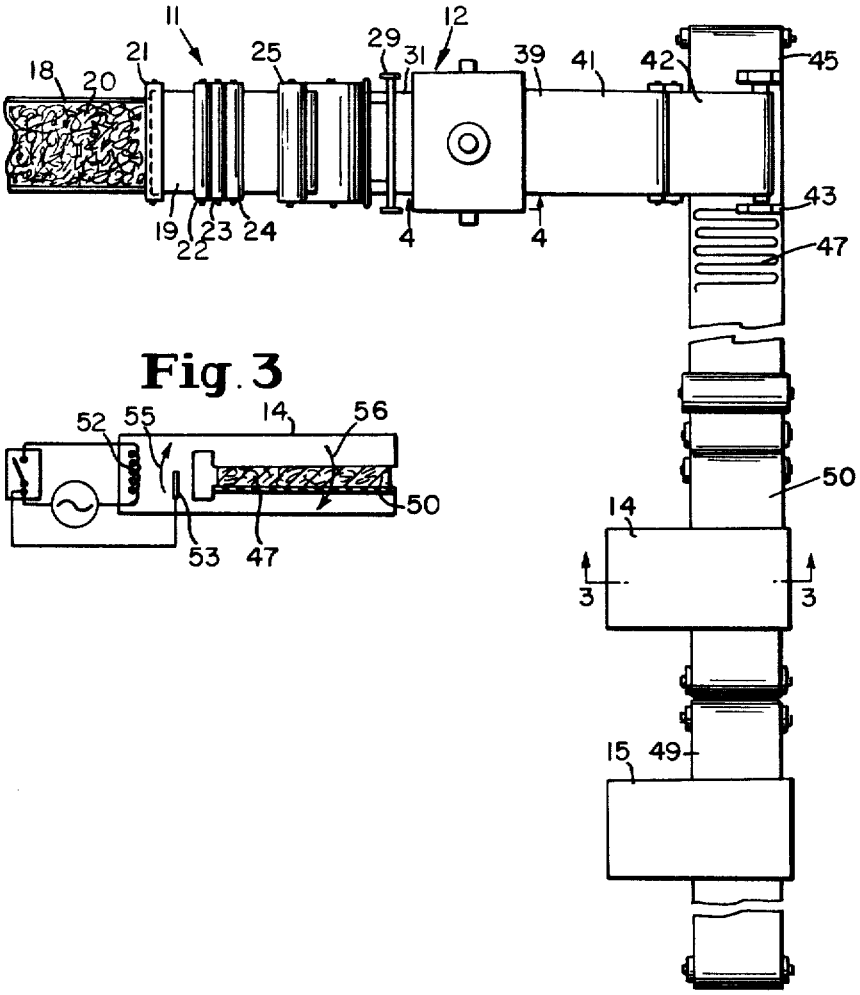
Fig. 3

PROCESS FOR CONTACTING A POWDER WITH A FIBROUS WEB

This is a continuation of copending application Ser. No. 074,677, filed Sept. 12, 1979, now abandoned.

It is known to apply dry powders to webs during the formation of batts for various purposes. For example, dry powdered boric acid is frequently applied to garnett webs of cotton which are subsequently cross laid or cross-lapped on a moving conveyor to form a batt, said batt having a certain degree of fire resistance resulting from the application of the boric acid powder and its mixture with the cotton in the web and the batt.

Other well-known processes involve the application to the web of either thermo-setting resins or thermo-plastic resins in dry powdered form, generally but not necessarily followed by cross-lapping the web to form a batt which is subsequently heated. In the case of thermosetting resins the material stiffens the fibers in the batt structure as the thermo-setting resin goes through the process of melting and hardening. A limited amount of bonding between fibers may occur with these resins. Thermo-plastic resins, on the other hand, generally flow to a greater extent on the fiber surfaces as the batt is heated, so that the melted resin forms more sites for inter-fiber bonding. The strength and functional utility of the bonds thus formed depend on the characteristics of the thermo-plastic resin, including its flow properties, its melting point, its tackiness or stickiness in molten form, and the toughness of the resin bond when it has been cooled again to a temperature below its softening point.

Various methods of applying dry powdered materials to fibrous webs have been disclosed in patents and publications, and several of these methods have found widespread commercial application. For example, one of the most widely used types of powder applicators is the strewer, which is essentially a hopper generally having a more-or-less V-shaped cross section. At the bottom of the "V" various means are used to meter out the required quantity of powder which thereafter falls by gravity onto the surface of the fibrous web which passes continuously beneath the strewer. Knurled rolls, doctor-blades, combinations of brushes and rolls, series of brushes, perforated rolls and belts, and other devices are used to release the desired quantity of powdered material from the strewer hopper. At the same time various devices may be needed to keep the powdered material uniformly suspended and distributed within the strewer hopper itself. Several types of paddles are sometimes employed, vibrators of various types are used, and in some cases the powdered material is even fluidized to ensure adequate flow through the metering device.

Strewers have many disadvantages. The strewer width must conform closely to the width of the fiber web in order to avoid either a loss of powder if the strewer is wider than the web, or to avoid areas of web which are untreated if the strewer is not as wide as the web. Metering a precise amount of powdered material is difficult, as the many varieties of strewer will attest. Among the major problems is the fact that the powder which is dropped by gravity tends to remain on the top of the web, thus leaving fibers which are untreated. With certain functional powders this leaves part of the batt non-functional or unprotected, or in the case of bonding resins, gives rise to the formation of a batt which has characteristic laminar qualities because layers which are bonded together by the resin carried on one side of the web alternate with layers between which there is little or no resin. Another disadvantage of strewers is that they tend to produce excessive amounts of powder dust in the air which is difficult to control. A further difficulty with strewers is that the powder must be metered into the strewer to maintain some reasonably constant supply of material while at the same time it must be metered out to ensure application of the proper amount of material onto the fibrous web. A double metering system has been employed in an effort to overcome this disadvantage, however such a system has the additional problem of coordinating the rates of the two systems.

Other methods of applying dry powdered materials to fibrous webs produced by carding or garnetting overcome some of the disadvantages of the strewer but introduce other problems which may include non-uniformity of application, low efficiency of powder usage, excess dust in the air, and incomplete coverage of the fiber web assembly. Because of their shortcomings few, if any, of these methods have found widespread commercial application.

Examples of prior art processes are described for example in Fleissner U.S. Pat. No. 3,765,971 and in Buck et al. U.S. Pat. No. 3,993,518, hereinafter referred to simply as "Buck".

Accordingly, it is an object of the present invention to provide an improved dry process for contacting a powder with a web and for producing a batt which processes are substantially free of the disadvantages of the prior art.

Another object is to provide a method for the intimate uniform impregnation of the fibers with the powdered material.

Still another object is to provide a method wherein the tendency of the layers of the web to form distinct laminations in the finished batt is eliminated, or minimized.

Yet another object is to provide an improved method wherein an even treatment of powder over the entire width of the fibrous web is achieved.

Still another object is to provide an improved method wherein virtually complete containment and control of powder dust is achieved.

Yet another object is to provide an improved method wherein essentially 100% efficiency in the use of the powder is attained.

Still another object is to provide an improved apparatus for intimately contacting a powder with a web.

Yet another object is to provide an improved apparatus for practicing the process of the present invention.

Additional objects and advantages of the present invention will be apparent to those skilled in the art by reference to the following detailed description and to the drawings which are briefly described below.

FIG. 1 is an elevation view of an apparatus suitable for practicing the process of the present invention.

FIG. 2 is a plan view of the apparatus of FIG. 1.

FIG. 3 is a sectional view taken along Line 3—3 of FIG. 2.

Figure 5:
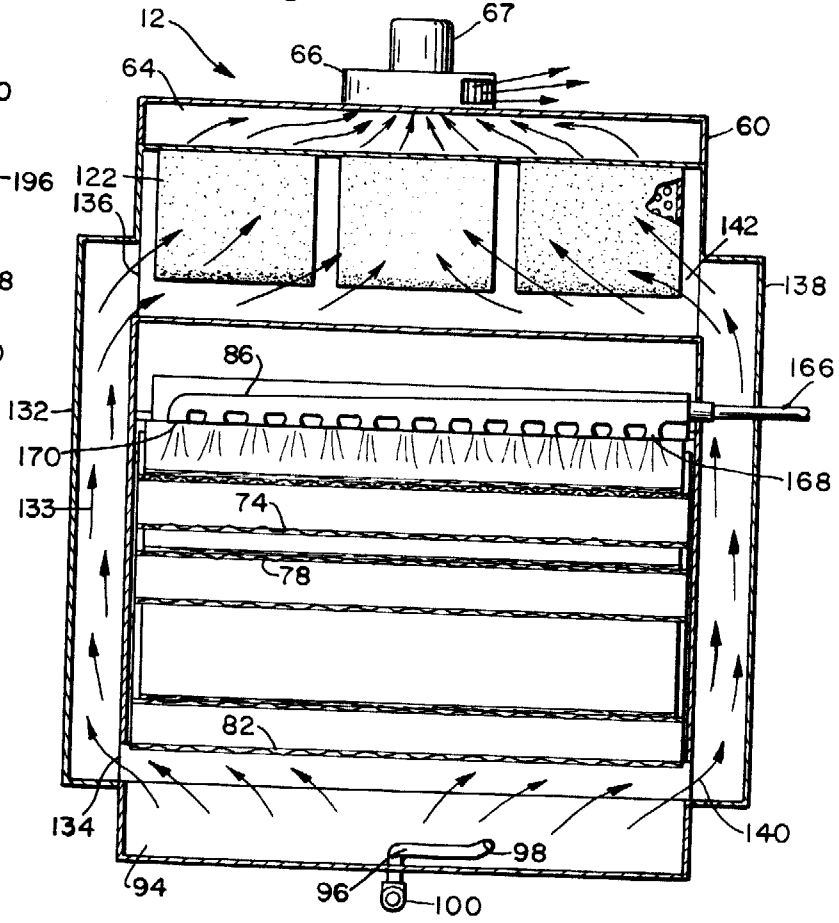
FIG. 5 is a sectional view taken along Line 5—5 of FIG. 4 which is identical to Line 5—5 of FIG. 1.

The above and other objects are accomplished according to the present invention by providing a process for intimately contacting a powder with a moving fibrous web comprising the steps of:

I. downwardly passing a mixture of powder and air through the moving fibrous web;

II. reversing the direction of movement of the fibrous web; and then

III. passing a mixture of powder and air through the moving fibrous web in a direction opposite to that of Step I.

According to another aspect of the present invention there is provided an apparatus for intimately contacting a moving fibrous web with a powder wherein the apparatus comprises:

A. a substantially air-tight enclosure;

B. means for maintaining subatmospheric pressure within the enclosure;

C. means for passing a fibrous moving web into the enclosure;

D. means within the enclosure for passing a first mixture of powder and air through the moving fibrous web;

E. means for reversing the direction of movement of the fibrous web;

F. means for passing a second mixture of powder and air through the moving fibrous web in a direction opposite to the direction of the first mixture; and G. means for passing the fibrous web from the enclosure.

The apparatus of the present invention includes an enclosure in which the fibrous web is treated with powder. Generally this enclosure is located immediately after the doffer of a garnett or carding machine, and ahead of the cross-lapping apparatus which deposits the web on the floor apron. Of course the apparatus may be used equally well to treat webs which are not cross-lapped but which continue from the apparatus in a tandem arrangement either for further treatment, such as heating in an oven, or for packaging in rolls or other forms.

The enclosure in which the web is treated preferably has only two openings, one through which the web enters, and a second from which it exits after treatment. These openings are generally, although not necessarily, formed by pairs of rolls between which the fibrous web passes. The powdered material to be applied to the web enters the enclosure in one or more enclosed pipes. Air is exhausted from the enclosure by a fan operating through filters as described below.

No conveyor for the web enters the enclosure, or exits from it. The elimination of such conveyors reduces the openings into the enclosure, and also eliminates the possibility that the conveyors themselves will carry powdered material out of the enclosure. In the apparatus of the present invention the fibrous web simply leaves a conveyor and itself enters the applicator enclosure. In the same way, it leaves an internal conveyor at a point within the enclosure before exiting the enclosure between a pair of rolls. There are, of course conveyors for the fibrous web which are within the applicator enclosure, but these conveyors remain entirely inside the enclosure so that they neither require entrance or exit ports, nor can they carry any powdered material out of the enclosure.

The entire enclosure is maintained under negative pressure. Thus there is a tendency for air to enter the applicator enclosure along with the fibrous web at the entrance port and even for some air to enter the enclosure around or between the rolls at the exit port. The maintenance of a significant negative pressure within the applicator enclosure prevents the dust or powdered material from escaping into the area outside the enclosure. Generally, the negative pressure within the enclosure is maintained by employing an exhaust fan which draws air through a series of bag filters which are contained within the enclosure. Alternative arrangements such as cyclones, or cyclones accompanied by filters, may also be used but are less preferred.

Within the enclosure the fibrous web, supported in part by conveyors, makes at least one change in direction. This permits both sides of the web to be treated with the powdered material which is injected into an air stream which moves in a single downward direction. The drawings discussed below illustrate an enclosure in which the web makes two changes of direction, but an enclosure having a single change in direction may accomplish the purposes described above. It will be noted that the powdered material passes through the web at least twice, from opposite sides of the web, but that the powdered material itself moves in a single downward direction.

Excess powder in the air is captured on the bag filters or similar devices and redeposited on the web. In order that this redeposition be made in a uniform manner, generally the bag filter is placed within a separate chamber inside the main applicator enclosure so that when shaking or reverse-pulse air puffing removes the accumulated powder from the bags it falls within the separate chamber from which it is dispensed uniformly and evenly across the width of the web passing beneath by a suitable series of rolls and brushes, or combinations thereof, or alternatively by a suitable vibratory feeder. The powdered material itself is introduced into the applicator enclosure suspended in a rapidly moving airstream contained in a suitable conveyor pipe. The precise amount of powdered material needed for application to the fibrous web is metered into this airstream by a suitable means, such as a screw feeder or vibratory feeder and generally enters the airstream itself through a venturi device. After the powdered material has entered the applicator enclosure through the air pipe in which it is suspended, it is distributed across the width of the fiber web and literally blown through the web by a suitable distributing device referred to herein as a wand or distributor, several examples of which are illustrated in the drawings herein. At least one wand or powder distributor is used. When a single wand or powder distributor is used, part of the powder being applied is blown completely through the web, thereafter impinging the web a second time on the opposite face after the web has made a turn within the applicator enclosure. Generally, however, it is preferable to employ a second wand or powder distributor to assure that sufficient powdered material is applied to the second side and then it in turn also has an opportunity to penetrate the entire web structure.

The excess powder which has passed through the web from both sides is collected and redeposited once again on the fiber web to ensure its complete and efficient use in the process. In the configuration in which the web makes at least two changes of direction much of the powdered material simply falls onto the top of the fiber web as it makes its final pass within the applicator enclosure, after which it is carried from the enclosure with the exiting web. At least a part of this powdered material, after passing through the web at least twice, is picked up and circulated back to the bag filter through plenums on either side of the enclosure which collect that excess powder from the bottom of the applicator enclosure. This recaptured powder is subsequently redeposited into the top surface of the web from the bag filter apparatus as described above.

All the conveyor belts which support and carry the web on its passage through the applicator enclosure are foraminous and are of an open mesh type, permitting free passage of air and powder through both the web and the conveyor belt where this is necessary and desirable. Thus it is possible to maintain a continuous flow of air in one downward direction through the web and the belts, that direction being coincidental with the direction in which the powder is injected into the webs from the wands or powder distributors.

Various means, including the use of compressed air fed through flexible hoses may be used to keep the powdered material sufficiently suspended in the bottom of the applicator enclosure so that it can be picked up in the return airstream which flows through the side plenums or ducts to the bag filters at the top of the enclosure.

Referring now to the drawings and in particular to FIGS. 1 and 2, there is shown an apparatus 10 useful for practicing the process of the present invention. The apparatus 10 comprises an opener or a garnett 11, an apparatus 12 for applying powder, a cross-laying mechanism 13 and, as shown in FIG. 2, an oven 14, and cooler 15. The garnett 11 comprises an inlet chute 18 adapted to feed bulk fibers to the rotating drum 19 of the garnett 11. The garnett 11 is also provided with a plurality of tooth rolls 21, 22, 23, 24, 25 which, together with the teeth not shown on the drum 19, take bulk fibers 20 and convert them to a web 31 which adheres to the drum 19. The web 31 adhering to the drum 19 is transferred to the drum 28 where it is removed by a comb 29. The thin, planar web 31 that is now only between 1 and 100 fibers thick and is barely self-supporting enters the apparatus 12 in a horizontally disposed position, where it is contacted with a powder as described more completely below.

The powder-treated web 39 then goes to the conveyor 41 and thence to the conveyor 42. In a manner well known in the art, the lower end of the conveyor 42 is attached to a traveller 43 which moves back and forth on a track 44. The conveyor 42 is positioned above and at right angles to a conveyor 45. The conveyors 42 and 45 are adjusted such that the speed of the conveyor 42 is several times faster than the speed of the conveyor 45. By virtue of this arrangement, the web 39 is cross-layered back and forth on the conveyor 45 thus forming an unheat-treated batt 47. The unheat-treated batt 47 passes onto a foraminous belt 50 (see FIG. 3) which passes into the oven 14. As shown in FIG. 3, the oven 14 is provided with heating means 52 which can be thermostatically controlled by a thermostat 53. The oven 14 is also provided with air circulating means not shown that causes the air to circulate in the direction shown by the arrows 55 and 56. Baffles not shown are provided at either side of the batt to ensure that the air circulates through, rather than around, the batt. These baffles are adjustable, to accommodate batts of different widths.

After leaving the oven, the batt 47 then enters an enclosed transition chamber not shown between the oven 14 and cooler 15, where it passes from the belt 50 of the oven and enters between an upper foraminous belt 49 and a lower foraminous belt not shown which compresses the batt 47. The upper belt 49 can be raised or lowered by means not shown, to control the thickness of the final batt. While held and compressed between the two belts, the batt 47 enters a cooler 15. In the cooler 15, cool air is moved by an air circulating means not shown through the batt 47 and the two foraminous belts. In this manner, the resin is frozen and the batt 47 assumes the thickness it had while compressed between the two belts. The resultant product is the final heat-treated batt.

Figure 4:
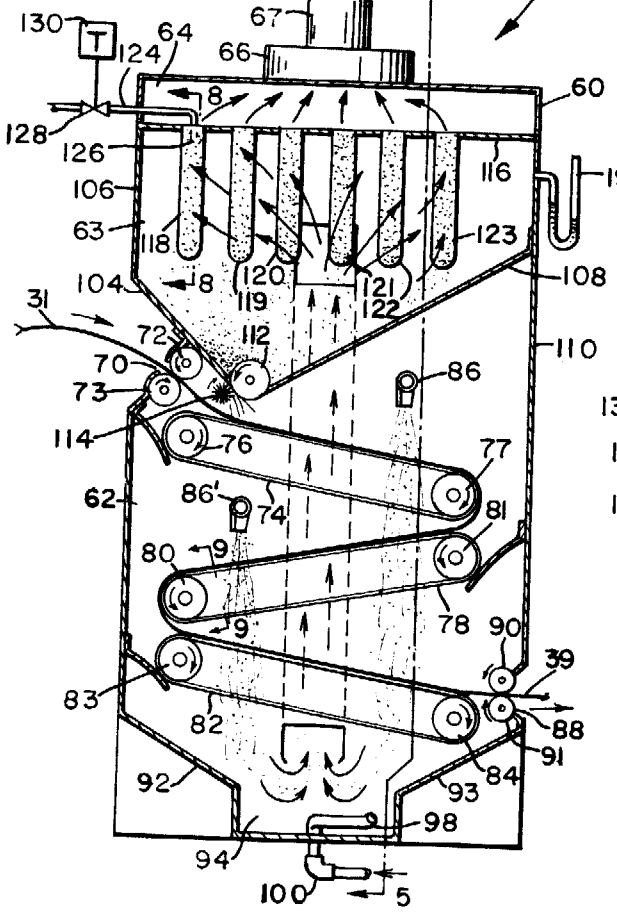
FIG. 4 is an enlarged sectional view taken along Line 4—4 of FIG. 2.

Referring now to FIGS. 4 and 5, there is shown in sectional view the apparatus 12 for applying powder to the web 31. The apparatus 12 has an air-tight enclosure 60. The air-tight enclosure 60 divides the apparatus 12 into a lower zone 62, an intermediate zone 63, and an upper zone 64. In the lower zone 62, the web 31 is contacted with powder. In the intermediate zone 63, the excess powder is collected and fed back onto the web 31. In the upper zone 64 air is removed by a fan 66 driven by a motor 67.

The lower zone 62 is provided with an entrance comprising an opening 70 to facilitate access of the web 31, and two rotating rolls 72, 73 adjacent to the opening 70 which are provided with means (not shown) to cause them to rotate in the direction of the arrows as shown. Within the lower zone 62 is an endless conveyor 74 which moves around rollers 76, 77 each of which rotate around their respective axes in the direction of the arrows shown thereon. Below the conveyor 74 is another endless conveyor 78 which moves around rollers 80, 81 in the direction of the arrows shown. In the preferred embodiment depicted in FIG. 4 the lower zone 62 is also provided with a third endless conveyor 82 adapted to circulate around rollers 83, 84. The lower zone 62 is provided with a powder distribution wand 86 positioned above the conveyor 74 and with a second powder distribution wand 86' positioned above the conveyor 78. The lower zone 62 is provided with an exit opening 88 to permit egress of the web 39. Adjacent to and parallel to the opening 88 are two rolls 90, 91 rotating in the direction of the arrows as shown. The bottom of the lower zone 62 is provided with inwardly sloping walls 92, 93 terminating in a central collecting wall 94. Within the well 94 is a stirrer 96 having flexible outlet hose 98 which is adapted to receive air under pressure from a pipe 100 connected to a compressed air source not shown. Air leaving the stirrer 96 from the hose 98 causes the stirrer 96 to rotate about the vertical portion of the pipe 100.

The intermediate zone 63 is provided with a first lower wall 104 which slopes downwardly and inwardly from the forward wall 106 of the air-tight enclosure 60. The intermediate zone 63 is also provided with a second lower wall 108 which slopes downwardly and inwardly from the rear wall 110 of the enclosure 60. The extreme lower end of the wall 104 and the extreme lower end of the wall 108 define a slot over the first conveyor 74 in which rotates a roll 112. The surface of the roll 112 is grooved or knurled in order to permit powder to adhere thereto. Below the roll 112 is a cylindrical brush 114 adapted to brush the surface of the roll 112 and remove powder therefrom. The roll 112 substantially fills the slot formed by the lower extremities of the walls 104, 108.

The intermediate zone 63 is provided with an upper wall 116. Depending from the upper wall 116 are a series of bag filters 118, 119, 120, 121, 122, 123. The bag filter 118 is provided with a compressed air pipe 124 terminating in a nozzle 126. The pipe 124 is provided with a valve 128 controlled by a timer 130. Each of the bag filters 119, 120, 121, 122, 123 and other bag filters not numbered are also provided with sources of high pressure air similar to the pipe 124.

Referring now to FIG. 5 it can be seen that the enclosure 60 is provided with an external plenum 132 in the form of a rectangular pipe 133 having a lower opening 134 in fluid communication with the bottom of the lower zone 62 and having an upper opening 136 in fluid communication with the intermediate zone 63. The enclosure 60 is also provided with a second plenum 138 having a lower opening 140 and an upper opening 142 the purpose and function of which are more completely described below.

Figure 6:
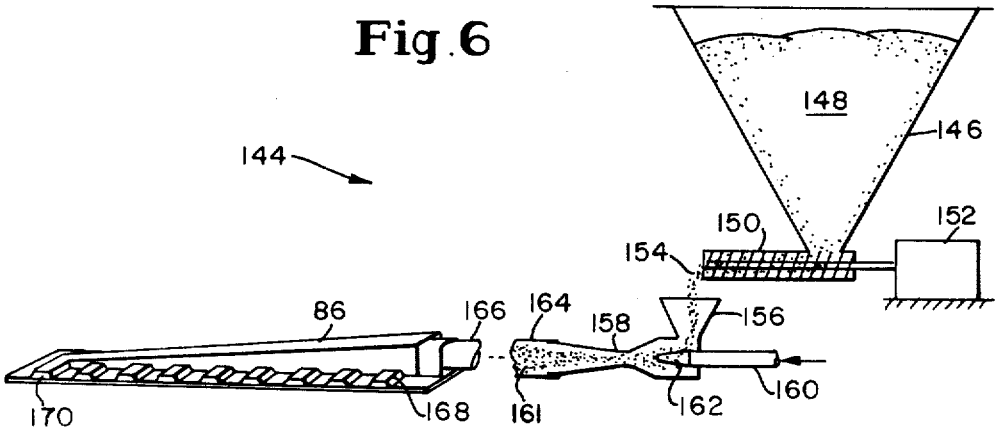
FIG. 6 is a schematic, exploded view of the powder distribution wand which is also shown in FIG. 5.

Referring now to FIG. 6 there is shown a powder metering and distribution apparatus 144 comprising a hopper 146 adapted to hold powder 148. The bottom of the hopper 146 is in communication with a screw conveyor 150 adapted to be turned by a variable speed motor 152. The speed of the motor 152 determines the amount of powder 154 leaving the end of the screw conveyor 150. The powder 154 drops into a second hopper 156 which is upstream of a venturi 158 supplied with a source of high pressure air (not shown) via pipe 160 terminating in nozzle 162. The venturi 158 ensures that the powder 154 will be admixed with the air when the powder-air mixture 161 leaves the venturi 158 via the pipe 164. The pipe 164 is in fluid communication with the pipe 166 which in turn is in fluid communication with the wand 86. As shown in FIG. 6 the wand 86 has been rotated 90° to more clearly show its structure. However, the area transverse to flow of the powder-air mixture 161 continually decreases such that the amount of the air-powder mixture 161 leaving the first opening 168 is the same as the amount of air-powder mixture 161 leaving the last opening 170. All structure shown in FIG. 6 is in the prior art.

Figure 7:
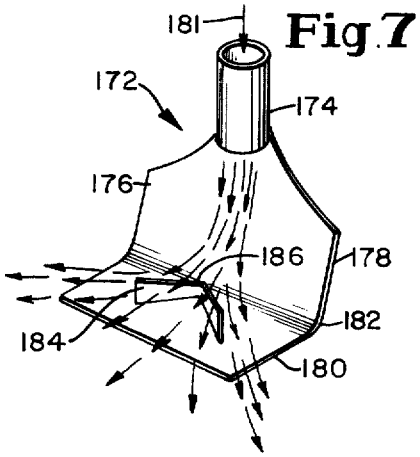
FIG. 7 shows a powder distribution means that is an alternative to the wand of FIG. 6.

Referring now to FIG. 7 there is shown an alternative powder distribution apparatus 172. The apparatus 172 comprises a pipe 174 adapted to be in fluid communication with the pipe 164 of FIG. 6. Attached to the pipe 174 is a deflection plate 176. The deflection plate 176 comprises a first portion 178 substantially parallel to the direction of flow as shown by the arrow 181. The plate 176 comprises a second portion 180 joined to the first portion 178 by an intermediate curved portion 182. Positioned on the second portion 180 is a V-shaped deflector 184 the vertex 186 of which is placed directly in line with the powder flow as shown by the arrow 181.

Figure 8:
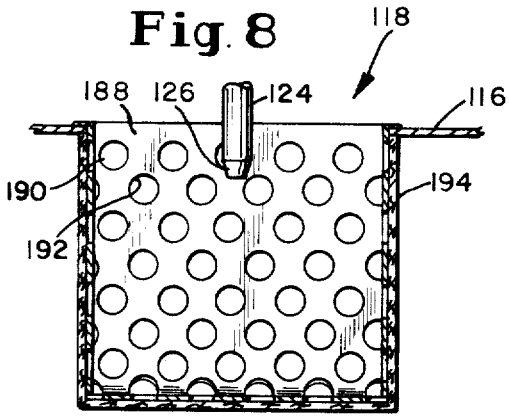
FIG. 8 shows a bag filter and is a sectional view taken along Line 8—8 of FIG. 4.

Referring now to FIG. 8, there is shown the bag filter 118 in an enlarged view. The bag filter 118 comprises a first metal plate 188 provided with a plurality of holes such as the holes 190, 192. The bag filter 118 is provided with a second plate not shown parallel to the first plate 188. A cloth bag 194 is placed over and completely surrounds the plate 188 and the parallel plate not shown. Excess powder collects on the outside of the bag 194 and will be held there by the difference in pressure on the outside of the bag 194 compared to the pressure on the inside of the bag 194. However this powder can be caused to be dislodged if the air pressure on the inside of the bag 194 is temporarily increased by a puff of high pressure air from the nozzle 126.

Figure 9:
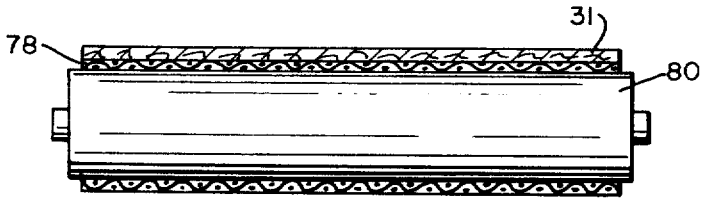
FIG. 9 shows the foraminous belt with a web thereon and is an enlarged sectional view taken along Line 9—9 of FIG. 4.

Referring now to FIG. 9 there is shown the roller 80 with its endless conveyor 78 supporting the web 31.

The operation of the apparatus 12 is best understood by reference to FIG. 4. In operation the web 31 enters the air-tight enclosure 60 through the opening 70 and through the nip of the rolls 72, 73. The web 31 then falls onto the conveyor 74 and, as it moves laterally, passes underneath the first discharge of powder caused by the action of the brush 114 against the roll 112. The web 31 now carried by the conveyor 74 passes underneath the wand 86 thereby receiving a second dose of powder. The web 31 is then turned downward and around on an axis perpendicular to the direction of movement of the web 31, until the web 31 is moving in a reversed direction and passes onto the foraminous belt of conveyor 78.

Some of the powder issuing from the wand 86 is retained on the web 31. A portion of the powder-air mixture passes through the web 31, through the upper portion of the conveyor 74 through the lower portion of the conveyor 74 and again contacts the web 31 while the web 31 is supported by the conveyor 78. As the web 31 supported by the conveyor 78 passes underneath the wand 86' a third dose of powder is given to the web 31.

Some of the powder issuing from the wand 86' is retained on the web 31. However, a portion of the powder-air mixture passes through the web 31 through the upper portion of the conveyor 78 and through the lower portion of the conveyor 78 and then again contacts the web 31 while the web 31 is supported on the upper portion of the conveyor 82. The web 31, which is now termed a powder-treated web 39, is carried by the upper portion of the conveyor 82 and then passes through the nip of rolls 90, 91 and exits from the enclosure 60 through the opening 88.

Air is removed from the enclosure 60 by the fan 66. The fan 66 draws air from the upper zone 64 of the enclosure 60, from the inside of the bag filters 118, 119, 120, 121, 122 and 123, and upward through the plenums 132 and 138. The fan 66 creates subatmospheric pressure within the enclosure 60 in general and in particular within the lower zone 62, the intermediate zone 63, and the upper zone 64 as shown by the liquid level in the manometer 196. Since the enclosure 60 is under a subatmospheric pressure external air tends to leak into the enclosure 60 whereas dust and powder-laden air are prevented from escaping. Air is supplied to the enclosure 60 as part of the air-powder mixture supplied by the wands 86, 86' and as part of the compressed air issuing from the hose 98 of the stirrer 96. Furthermore, air leaks into the enclosure 60 through the openings 70, 88. However, a size of fan 66 and driving motor 67 are selected in order to remove all of the air that enters the enclosure 60 from any source whatsoever while still maintaining a subatmospheric pressure within the enclosure 60 as shown by the manometer 196. The preferred subatmospheric pressure is between one-half and five inches of water.

Another important aspect of the present invention is the internal flow of powder and of air. Powder is supplied to the web 31 by means of the wands 86, 86'. However the powder which drops to the bottom of the lower zone 62 of the enclosure 60 encounters the inwardly slanting walls 92, 93 and drops into the well 94 where the powder is again entrained in air by means of the stirrer 96. The fan 66 draws air from the opening 136 as shown in FIG. 5 from the plenum 132 and also from the well 94 through the opening 134. This ensures that the general flow of air and powder is downward in the lower zone 62 and is upward in the plenums 132, 138. The powder-air mixture is drawn to the bags 194 (see FIG. 8) whereupon the powder stops on the outside of the bag and the air travels through the bag 194 through the upper zone 64 of the enclosure 60 and from the enclosure 60 under influence of the fan 66.

Under the influence of puffing, as described above, powder is caused to drop from the outside of the bag filters 118, 119, 120, 121, 122, 123 which powder then falls onto the inwardly slanting walls 104, 108, contacting the knurled roll 112. The powder which is deposited in this manner in the intermediate zone is then dropped onto the web 31 as the powder is brushed from the roll 112 by the brush 114.

An alternative method of dropping excess powder onto the web 31 is to have an endless conveyor belt in the position of the sloping floor 108 carry the excess powder to a brush in the position of roll 112, which brushes the powder off the belt.

By virtue of the above description it can be seen that only filtered air is removed from the enclosure 60 and that the escape of powder is virtually completely eliminated. Furthermore, because of the automatic cleaning of the bag filters such as the bag filter 118 all powder that enters the enclosure 60 is eventually deposited on the web 31. An additional advantage is that both sides of the web 31 are contacted with powder. Calling the upper side of the web 31 its first side it can be seen that the first side of the web 31 is contacted with powder as the web 31 is supported by the conveyor 74. However, as the web 31 is supported on the second conveyor 78 it is the second side of the web 31 that is directly exposed to the powder issuing from the wand 86'. In this manner both sides of the web 31 are intimately contacted with powder. Therefore, when the powder-treated web 39 is cross-lapped onto the conveyor 45 as shown in FIGS. 1 and 2 by means of the cross-laying mechanism 13; each side of the web is contacted with a side of the web that has previously been coated with powder. When the powder contains a thermo-plastic or thermo-setting adhesive this coating of both sides of the web is exceedingly important since it ensures good bonding between layers of the web and reduces the tendency of the finished batt 58 to delaminate.

A wide variety of fibers can be employed in the present invention including those of cotton, polyester, acrylic, nylon, wool, polypropylene, modacrylic, acetate, and mixtures thereof.

The apparatus and process of the present invention can be employed with a wide variety of powders. Examples of classes of powders include among others thermo-plastic resins, thermo-setting resins, and inorganic materials. Specific examples of thermo-plastic resins include among others polyethylene, polyvinyl chloride, and copolymers of vinyl chloride and vinylidine chloride. Specific examples of thermo-setting resins include among others phenol-formaldehyde resins, urea-formaldehyde resins, and other thermo-setting resins well known to impart wash and wear characteristics to fabrics.

A wide variety of inorganic materials can be employed to impart flame resistance, glow resistance, and other properties to the final batt. Specific examples of inorganic materials include among others boric acid, diammonium phosphate and monoammonium phosphate.

The batts produced in accordance with the present invention find utility as padding in mattresses, and in upholstered furniture of all kinds such as chairs and sofas.

The invention may be understood by reference to the following non-limiting examples. These examples are designed to teach those skilled in the art how to practice the invention and represent the best mode contemplated for practicing the invention. Unless otherwise specified, all parts and percentages are by weight.

EXAMPLE 1

A powder which is a copolymer of vinyl chloride and vinylidene chloride available from the Dow Chemical Company, Midland, Mich., under the designation Saran Resin 506 is added to a fibrous web in the manner described above with respect to the drawings. This copolymer has a weight ratio of vinyl chloride to vinylidene chloride of 10:90, a chlorine content of 71%; a plasticizer content of 1%; a minimum particle size of 2 microns, a maximum particle size of 50 microns, and an average size of 11 microns. The powder is added at a rate such that it increases the weight of the web by 15%. The oven temperature is 425° F.

EXAMPLE 2

The procedure of Example 1 is repeated except that the powder is replaced by a powder that is 4 parts by weight of the copolymer of Example 1 and 1 part by weight of monoammonium phosphate.

Although the invention has been described in considerable detail with reference to certain preferred embodiments thereof it will be understood that modifications and variations can be made without departing from the spirit of the invention as given above and without departing from the scope of the appended claims.

What is claimed is:

1. A process for intimately contacting a moving fibrous web with a powder comprising the steps of:

I. passing a mixture of powder and air through the moving fibrous web;

II. reversing the direction of movement of the fibrous web; and then

III. passing a mixture of powder and air through the moving fibrous web in a direction opposite to that of Step I.

2. A process for intimately contacting a moving fibrous web with a thermally activatable adhesive powder comprising the steps of:

I. downwardly passing a mixture of powder and air through the fibrous web while the fibrous web is moving laterally;

II. reversing the direction of lateral movement of the fibrous web to a direction opposite to the direction of lateral movement in Step I thereby passing the moving web directly underneath that portion of the moving web moving in accordance with Step I; and then III. downwardly passing a mixture of powder and air through the moving fibrous web in a direction opposite to that employed in Step I.

3. The process of claim 2 wherein steps I through III are performed in a substantially air-tight enclosure.

4. The process of claim 3 further comprising the step of maintaining the enclosure at subatmospheric pressure.

5. The process of claim 3 further comprising the step of moving the web into the enclosure between two rollers.

6. The process of claim 3 further comprising the step of moving the web out of the enclosure between two rollers.

7. The process of claim 2 further comprising the step of collecting excess powder which has fallen through the moving fibrous web in a collecting well below the web.

8. The process of claim 7 further comprising the step of conveying the excess powder from the collecting well to a zone located above the moving web.

9. The process of claim 8 further comprising the step of dropping the excess powder from the zone above the web down onto the web.

10. The process of claim 8 wherein the excess powder is conveyed by an upwardly moving airstream.

11. The process of claim 9 wherein the excess powder is dropped uniformly across the width of the web.

12. A dry process for producing a batt comprising the steps of:

I. forming a horizontally disposed, thin, planar web of fibers, said web being from 1 to 100 fibers thick;

II. moving the fibrous web laterally on a foraminous belt;

III. downwardly passing a mixture of particles of a copolymer of vinyl chloride and vinylidene chloride and air through the fibrous web while the fibrous web is moving laterally;

A. wherein the weight ratio of vinyl chloride to vinylidene chloride in the copolymer is 5:95 to 25:75, B. wherein the weight ratio of the copolymer to the fiber is 10:90 to 20:80, C. wherein the copolymer particles have a size range of 2 microns to 100 microns, D. wherein the particles fall on the web and through the web and the belt under the influence of gravity, IV. turning the web downward and around on an axis perpendicular to the direction of the web's original lateral movement until the direction of lateral movement of the fibrous web is reversed to a direction opposite the direction of lateral movement in Steps II and III, thereby establishing a reversed portion of the web;

V. passing the reversed portion of the web onto a second foraminous belt lying directly underneath that portion of the web moving in accordance with Step II wherein the particles falling through the moving web and the belt in accordance with Step III fall on the reversed portion of web and excess particles fall through the reversed portion of the web and the second belt;

VI. downwardly passing a mixture of the particles and air through the reversed portion of the web in a direction opposite to that employed in Step III, wherein excess particles fall through the reversed portion of the web and the second belt;

VII. collecting the excess particles in a collecting well under the belts:

VIII. drawing air upward through two plenums from the collecting well to a zone above the web;

IX. conveying the excess particles in the collecting well in the upward moving airstream in the plenums to the zone above the web;

X. depositing the conveyed excess particles in the zone above the web;

XI. dropping the excess particles from the zone above the web down onto the web;

XII. forming the web into a batt by laying the web transversely back and forth on a moving belt such that the batt comprises a plurality of webs;

XIII. heating the batt to a temperature of 400° to 450° while the batt is being passed through an oven on a foraminous belt while hot air is forced through the belt and through the batt to melt the copolymer;

XIV. cooling the batt to room temperature while the batt is being passed through a cooler between two parallel foraminous belts while cool air is forced through the belts and the batt to resolidify the copolymer.

13. A process for intimately contacting a moving fibrous web with a thermally activatable adhesive powder comprising the steps of:

I. downwardly passing a mixture of powder and air through the fibrous web while the fibrous web is moving laterally;

II. reversing the direction of lateral movement of the fibrous web to a direction opposite to the direction of lateral movement in Step I thereby passing the moving web directly underneath that portion of the moving web moving in accordance with Step I; and then III. downwardly passing a mixture of powder and air through the moving fibrous web in a direction opposite to that employed in Step I; and then IV. again reversing the direction of lateral movement of the fibrous web to a direction substantially parallel to the direction in Step I.

14. A process for intimately contacting a moving fibrous web with a thermally activatable adhesive powder comprising the steps of:

I. downwardly passing the mixture of powder and air through the fibrous web while the fibrous web is moving laterally and while the fibrous web is contained within an enclosure maintained at subatmospheric pressure; and then II. reversing the direction of lateral movement of the fibrous web to a direction opposite to the direction of lateral movement in Step I thereby passing the moving web directly underneath that portion of the moving web moving in accordance with Step I whereupon the web is contacted with powder that passed through the web in Step I all while the web is contained within an enclosure at subatmospheric pressure; and then III. removing the web from the enclosure at subatmospheric pressure; and then IV. lapping the web back and forth on itself whereupon the multiple layers of web become a batt; and then V. heating the batt to a temperature sufficient to thermally activate the adhesive thereby producing a batt substantially free of a tendency to delaminate.

15. A dry process for producing a batt comprising the steps of:

I. forming a horizontally disposed, thin, planar web of fibers;

II. moving the fibrous web laterally on a foraminous belt;

III. downwardly passing a mixture of particles of a thermally activatable adhesive and air through the fibrous web while the fibrous web is moving laterally;

IV. turning the web downward and around on an axis perpendicular to the direction of the web's original lateral movement until the direction of lateral movement of the fibrous web is reversed to a direction opposite the direction of lateral movement in Steps II and III, thereby establishing a reversed portion of the web;

V. passing the reversed portion of the web onto a second foraminous belt lying directly underneath that portion of the web moving in accordance with Step II wherein the particules falling through the moving web and the belt in accordance with Step III fall on the reversed portion of web and excess particles fall through the reversed portion of the web and the second belt;

VI. downwardly passing a mixture of the particles and air through the reversed portion of the web in a direction opposite to that employed in Step III, wherein excess particles fall through the reversed portion of the web and the second belt;

VII. forming the web into a batt by laying the web transversely back and forth on a moving belt such that the batt comprises a plurality of webs;

VIII. heating the batt to a temperature sufficient to thermally activate the adhesive while the batt is being passed through an oven on a foraminous belt while hot air is forced through the belt and through the batt;

IX. cooling the batt to room temperature.

16. A dry process for producing a belt comprising the steps of:

I. mixing air with a thermally activatable adhesive powder to form an air-powder mixture; and then II. passing the air-powder mixture downwardly through a moving air-permeable fibrous web wherein the web is disposed in the form of the letter "S" such that the air-powder mixture passes through the web three times, twice in one direction and once in the opposite direction, thereby causing a portion of the powder in the air-powder mixture to adhere to the fibers of the fibrous web;

wherein that portion of the powder which does not adhere to the fibrous web is collected and passed again through a different portion of the fibrous web;

wherein the passing of the air-powder mixture through the fibrous web is conducted in an enclosure maintained at sub-atmospheric pressure in order to confine all powder to the enclosure except that powder adhering to the fibrous web; and then III. forming the web into a batt; and then IV. heating the batt to a temperature sufficient to activate the thermally activatable adhesive powder thereby bonding the fibers to one another to produce a batt having uniform physical properties due to the uniform distribution of the powder throughout the batt.

* * * * *